US012680483B2

(12) United States Patent
Cromer

(10) Patent No.: US 12,680,483 B2
(45) Date of Patent: Jul. 14, 2026

(54) ENGINE-OIL DIPSTICK HAVING A MAGNET

(71) Applicant: Figurati Designs, LLC, Akron, OH (US)

(72) Inventor: Kerry Cromer, Akron, OH (US)

( * ) Notice: Subject to any disclaimer, the term of this patent is extended or adjusted under 35 U.S.C. 154(b) by 0 days.

(21) Appl. No.: 19/061,091

(22) Filed: Feb. 24, 2025

(65) Prior Publication Data

US 2025/0270945 A1 Aug. 28, 2025

Related U.S. Application Data

(60) Provisional application No. 63/556,859, filed on Feb. 22, 2024.

(51) Int. Cl.
*F01M 11/12* (2006.01)
*F01M 11/03* (2006.01)
*F01M 1/10* (2006.01)

(52) U.S. Cl.
CPC ..... *F01M 11/12* (2013.01); *F01M 11/03* (2013.01); *F01M 2001/1042* (2013.01); *F01M 2011/031* (2013.01)

(58) Field of Classification Search
CPC .. F01M 11/12; F01M 11/03; F01M 2011/031; F01M 2001/1042; F01M 2011/144; F01M 2001/1007
See application file for complete search history.

(56) References Cited

U.S. PATENT DOCUMENTS

| | | | | |
|---|---|---|---|---|
| 2,993,723 | A | 7/1961 | Twachtman | |
| 11,396,976 | B1 * | 7/2022 | Bodary | B03C 1/288 |
| 2004/0065291 | A1 | 4/2004 | Callini et al. | |
| 2010/0315246 | A1 * | 12/2010 | Gilpatrick | G01F 23/04 340/623 |
| 2021/0223086 | A1 | 7/2021 | Swenson et al. | |
| 2022/0003136 | A1 * | 1/2022 | Klosterberg | F01M 11/0004 |

FOREIGN PATENT DOCUMENTS

| | | |
|---|---|---|
| CN | 201944535 U | 8/2011 |
| CN | 202732032 U | 2/2013 |

* cited by examiner

*Primary Examiner* — Jacob M Amick

(57) ABSTRACT

An engine-oil dipstick having a magnet having a cap assembly that is configured to removably attach to a dipstick entry orifice of a combustion-engine sump; a dipstick element having a first end and a second end; the first end of the dipstick element attached to the cap assembly; a magnet that generates a magnetic field, the magnet having a first half and a second half; the second half of the magnet being closer to the second end of the dipstick than the first half of the magnet; the second half of the magnet being substantially encapsulated within the dipstick element.

2 Claims, 8 Drawing Sheets

ENGINE-OIL DIPSTICK HAVING A MAGNET

CROSS-REFERENCE TO RELATED APPLICATIONS

This patent application claims priority to pending U.S. provisional patent application 63/556,859 having a filing date of Feb. 22, 2024. The subject matter of U.S. provisional patent application 63/556,859 is incorporated by reference into this application.

BACKGROUND OF THE INVENTION

There remains a need for filtering or removing ferromagnetic particulates from engine oil within a combustion-engine sump.

BRIEF SUMMARY OF THE INVENTION

An engine-oil dipstick having a magnet having a cap assembly that is configured to removably attach to a dipstick entry orifice of a combustion-engine sump; a dipstick element having a first end and a second end; the first end of the dipstick element attached to the cap assembly; a magnet that generates a magnetic field, the magnet having a first half and a second half; the second half of the magnet being closer to the second end of the dipstick than the first half of the magnet; the second half of the magnet being substantially encapsulated within the dipstick element.

An engine-oil dipstick having a magnet having a cap assembly that is configured to removably attach to a dipstick entry orifice of a combustion-engine sump; a dipstick element having a first end and a second end; the first end of the dipstick element attached to the cap assembly; a magnet that generates a magnetic field, the magnet having a first half and a second half; the second half of the magnet being closer to the second end of the dipstick than the first half of the magnet; the second half of the magnet being substantially encapsulated within the dipstick element; the second half of the magnet having a second-half-of-the-magnet surface area; the portion of the second end of the dipstick that substantially encapsulates the second half of the magnet having an exterior surface; the exterior surface having an exterior-surface surface area; the exterior-surface surface area being greater than the second-half-of-the-magnet surface area.

An engine-oil dipstick having a magnet having a cap assembly that is configured to removably attach to a dipstick entry orifice of a combustion-engine sump; a dipstick element having a first end and a second end; the first end of the dipstick element attached to the cap assembly; a magnet that generates a magnetic field, the magnet having a first half and a second half, the second half of the magnet being closer to the second end of the dipstick than the first half of the magnet; the second half of the magnet being substantially encapsulated within the dipstick element; the dipstick element having a length that, upon attaching the cap assembly to a dipstick entry orifice of a combustion-engine sump, is configured to at least partially submerge the second half of the magnet that is substantially encapsulated within the dipstick element beneath a liquid-fill level within a combustion-engine sump.

An advantage of the disclosed embodiments is that at the distal end of the dipstick element, the distal end of a magnetic element is substantially encapsulated therein. Because of this substantial encapsulation, the surface area upon which ferromagnetic materials can collect is increased beyond the magnet's natural surface area.

DETAILED DESCRIPTION OF THE INVENTION

Figure 1:
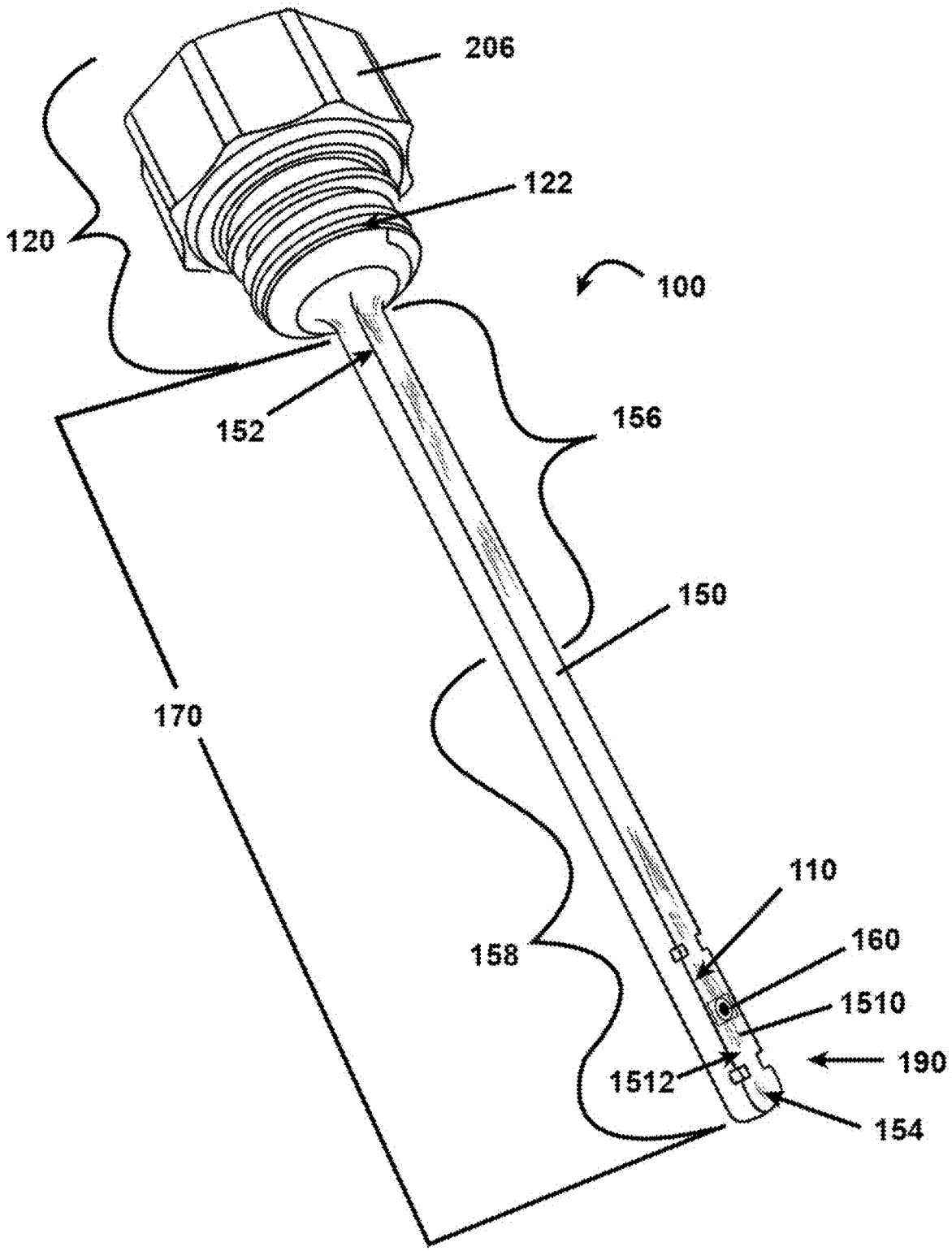
FIG. 1 shows a perspective view of a dipstick embodiment.

Embodiments are directed to engine-oil dipstick 100 having magnet 110 that generates magnetic field 118.

As shown in the figures, engine-oil dipstick 100 includes cap assembly 120 having cap-assembly threading element 122 that is configured to mate with complimentary threading element 144 on a dipstick entry orifice 142 of a combustion-engine sump 140.

In embodiments shown in FIGS. 1-4, cap assembly 120 is fixedly attached to first end 152 of dipstick element 150 such that dipstick element 150 is in a fixed position relative to cap assembly 120. In these fixed-position embodiments, cap assembly 120 includes cap knob 206 and cap-assembly threading element 122.

Figure 5:
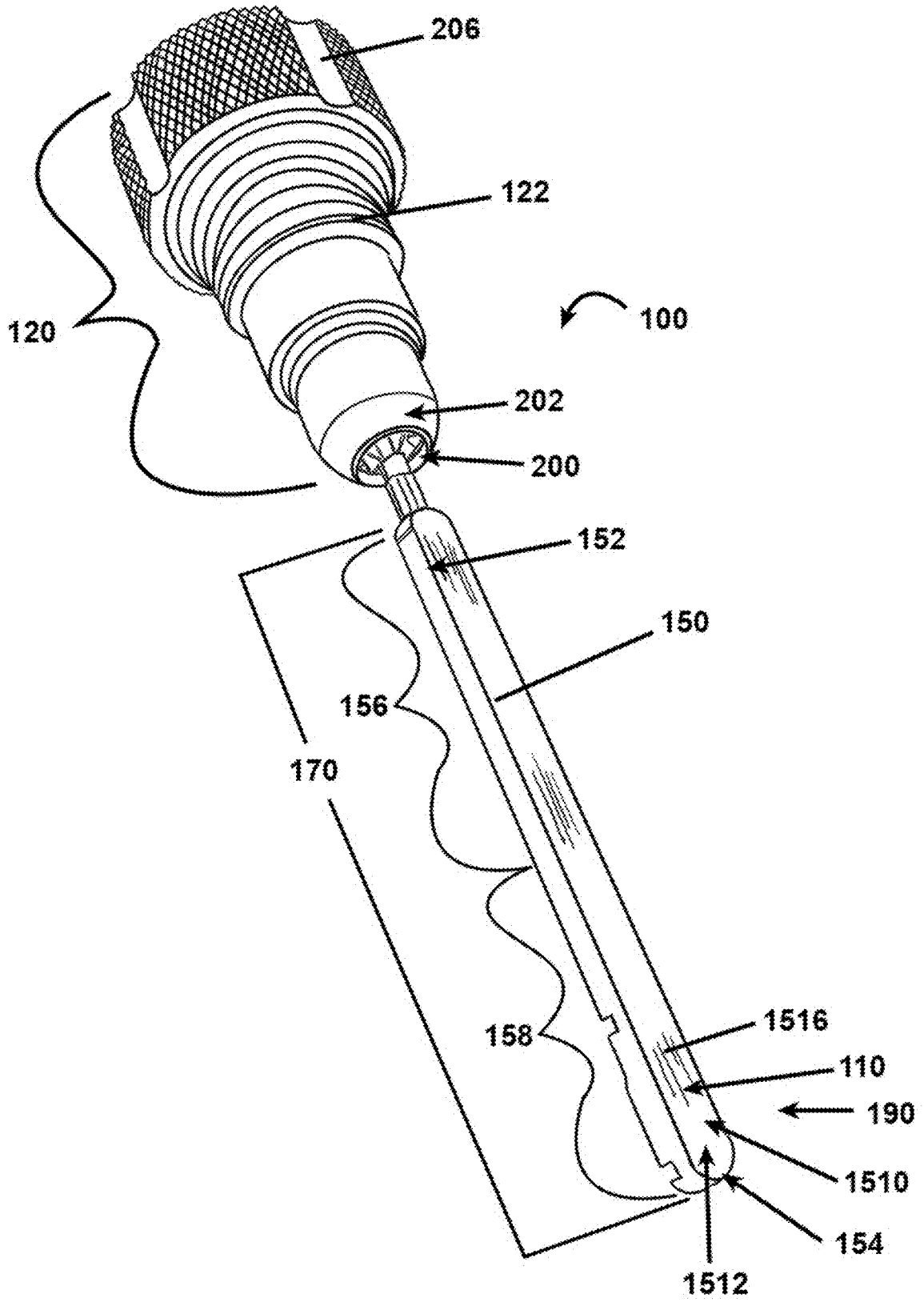
FIG. 5 shows a perspective view of an embodiment.
Figure 6:
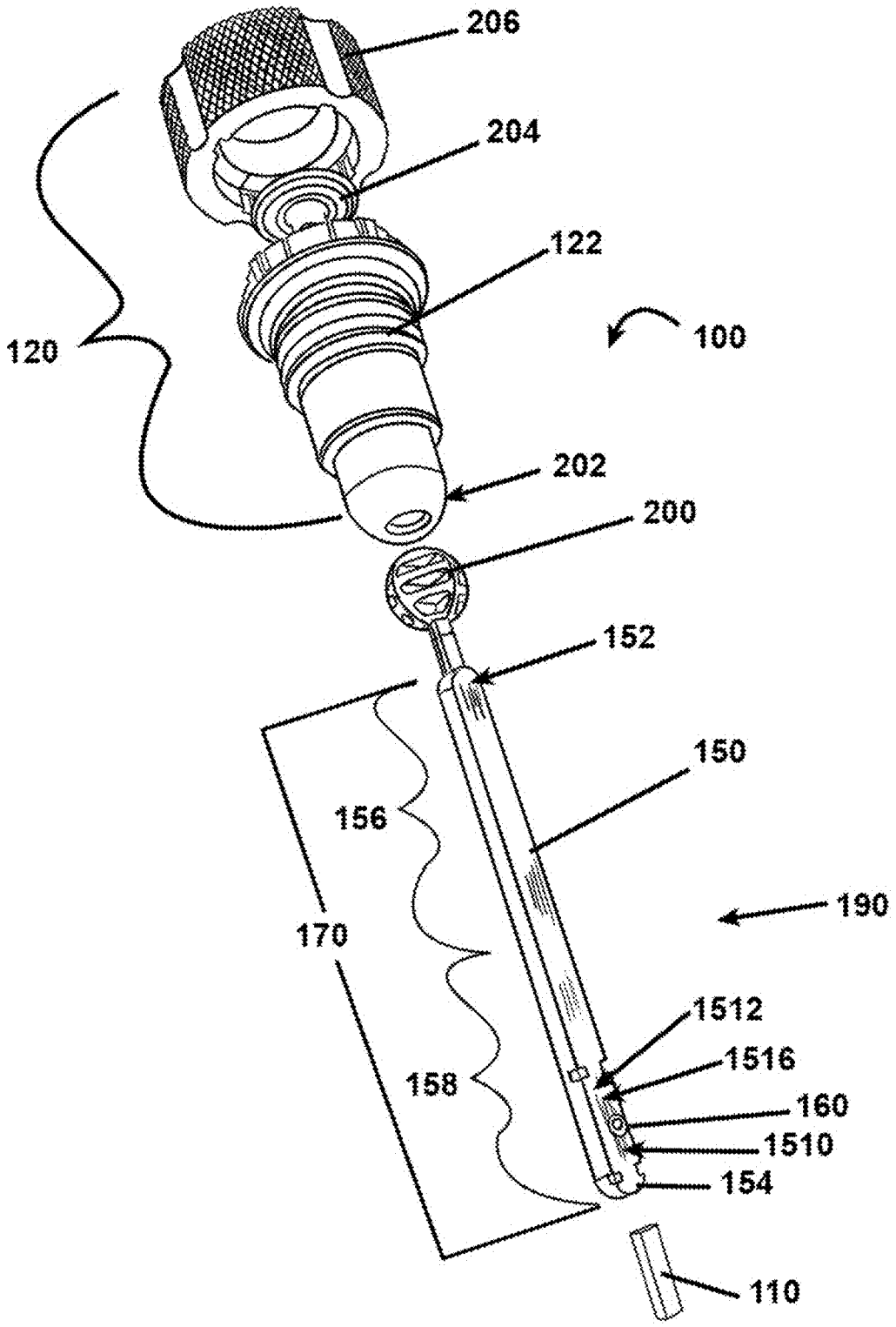
FIG. 6 shows an exploded perspective view of a dipstick embodiment.

In other embodiments, shown in FIGS. 5-6, cap assembly 120 is rotatably attached to first end 152 of dipstick element 150 via ball 200 and socket 202 such that dipstick element 150 is movable relative to cap assembly 120; the attached connection that is achieved by ball 200 and socket 202 allows dipstick element 150 to assume a variety of angular positions relative to cap assembly 120. In embodiments that include ball 200 and socket 202, and as shown in FIGS. 5-6, cap assembly 120 includes cap knob 206, plug 204, cap-assembly threading element 122, and socket 202 (that mates with ball 200 that is fixedly attached to first end 152 of dipstick element 150).

Figure 2:
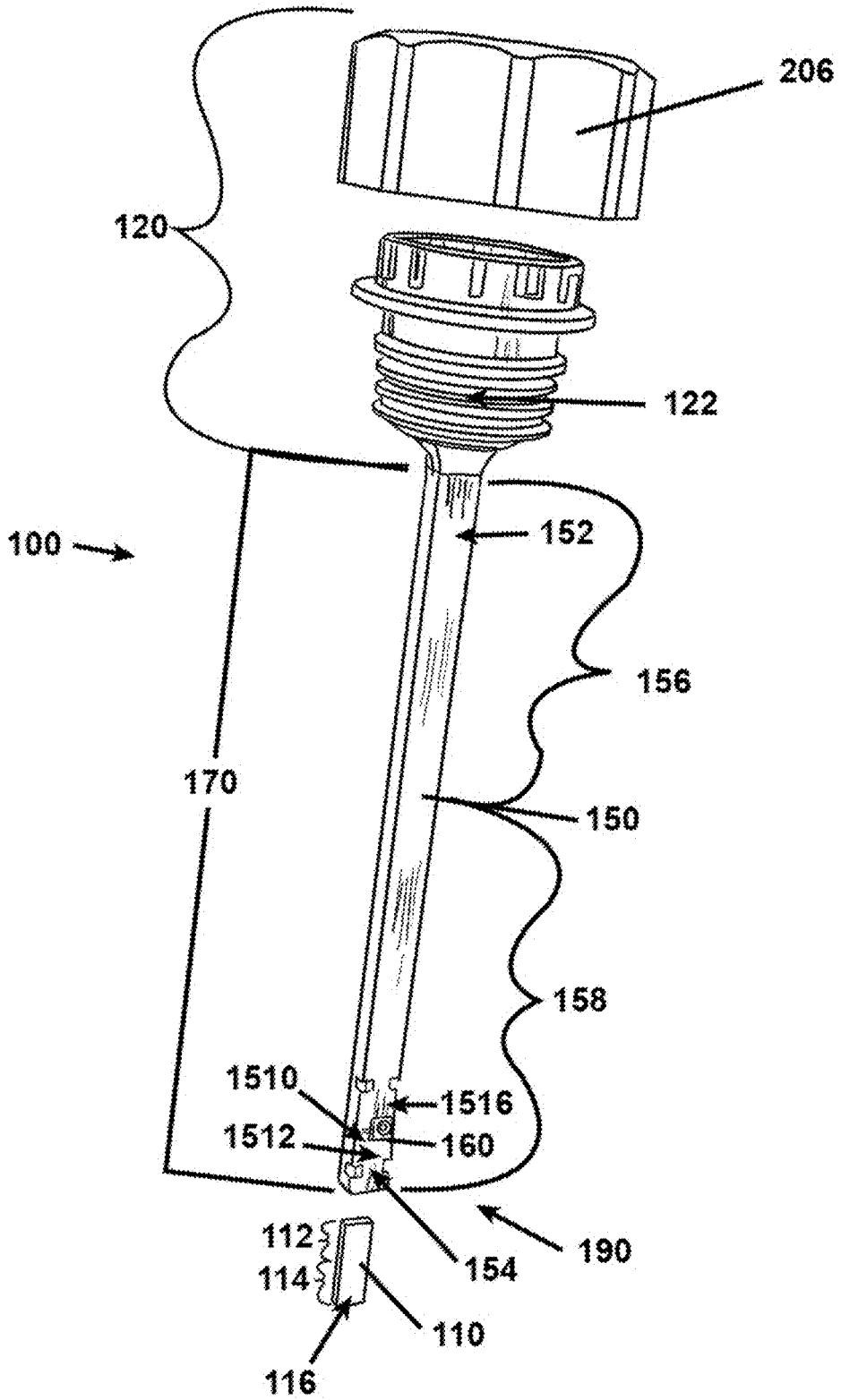
FIG. 2 shows an exploded perspective view of a dipstick embodiment.
Figure 3:
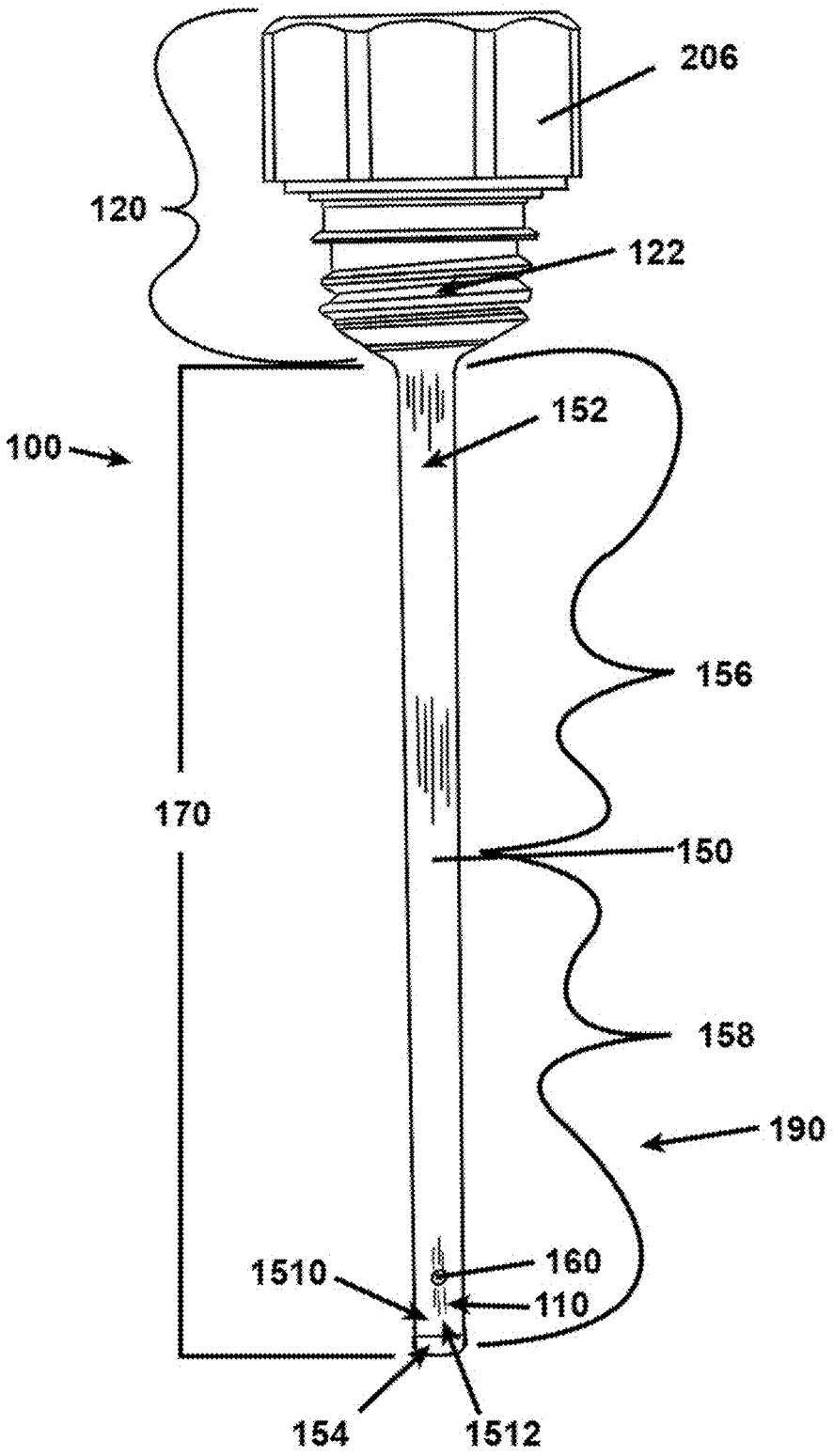
FIG. 3 shows a side view of a dipstick embodiment.
Figure 4:
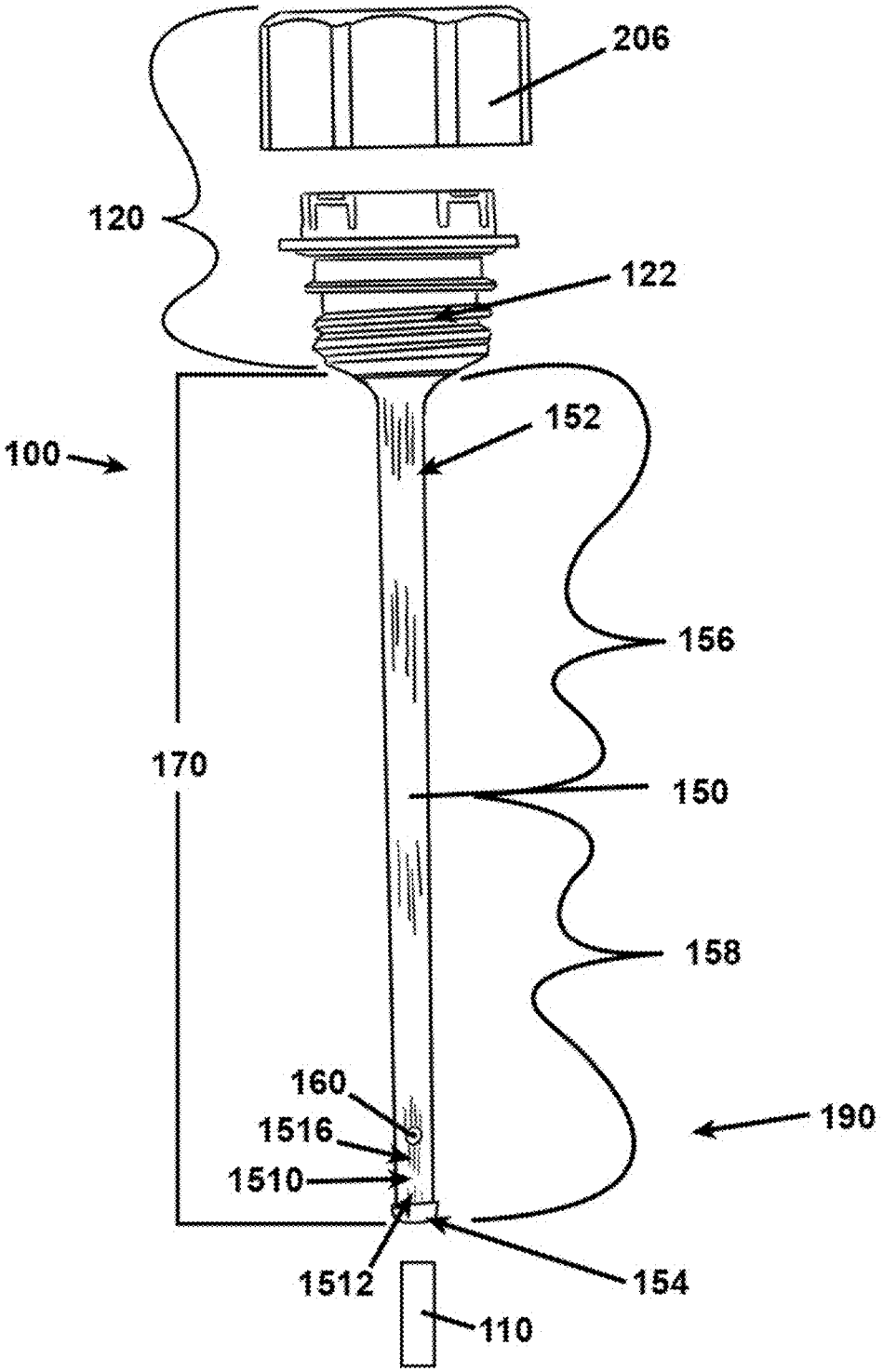
FIG. 4 shows an exploded side view of a dipstick embodiment.

Dipstick element 150 has first end 152, second end 154, first half of the dipstick element 156 (that includes first end 152), and second half of the dipstick element 158 (that includes second end 154). As shown in FIGS. 1, 3, and 5; and because these figures show dipstick element 150 as having an opaque exterior surface, magnet 110 is shown with an arrow as being substantially encapsulated within second half of dipstick element 158 within or proximate to second end 154. Exploded views shown in FIGS. 2, 4, and 6 show magnet 110 located within or proximate to dipstick-element second end 154. To add even more clarity to embodiment positions of magnet 110 within or proximate to dipstick-element second end 154, orifice 160 is configured to allow visibility of magnet 110 that is substantially encapsulated within second half of dipstick element 158.

In embodiments in which magnet 110 is described as being substantially encapsulated within second half of dipstick element 158, "substantially encapsulated" means that at least 90% of magnet 110 surface area is covered by second half of dipstick element 158. In other embodiments, substantially encapsulated means that at least 80% of magnet 110 surface area is covered by second half of dipstick element 158. In still other embodiments, substantially encapsulated means that at least 70% of magnet 110 surface area is covered by second half of dipstick element 158.

As shown in FIG. 2, magnet 110 has magnet first half 112, magnet second half 114, and second-half-of-the-magnet surface area 116. Magnet first half 112 is positioned closer to dipstick-element first end 152 than magnet second half 114; likewise, magnet second half 114 is positioned closer to dipstick-element second end 154 than magnet first half 112. In embodiments, at least magnet second half 114 is substantially encapsulated within second half of dipstick element 158; in other embodiments, both magnet first half 112 and magnet second half 114 are substantially encapsulated within second half of dipstick element 158. In embodiments, either magnet first half 112 or magnet second half 114 is visible through orifice 160.

In embodiments in which magnet second half 114 is described as being substantially encapsulated within second half of dipstick element 158, at least 90% of second-half-of-the-magnet surface area 116 is covered by second half of dipstick element 158. In other embodiments, at least 80% of second-half-of-the-magnet surface area 116 is covered by second half of dipstick element 158. In still other embodiments, at least 70% of second-half-of-the-magnet surface area 116 is covered by second half of dipstick element 158.

As shown in the figures, dipstick-element portion 1510 substantially encapsulates magnet second half 114. Dipstick-element portion 1510 has dipstick-element exterior surface 1512 that has a surface area. Because magnet second half 114 is encapsulated within dipstick-element portion 1510, the surface area of dipstick-element exterior surface 1512 is necessarily greater than second-half-of-the-magnet surface area 116. Mathematically, this can be generally understood as second-half-of-the-magnet surface area 116 $X^2$ being less than the dipstick-element surface 1512 having a surface area $[X+Y]^2$ wherein both X and Y are positive integers; stated differently, $X^2<[X+Y]^2$. This increased surface area (represented as $[X+Y]^2$), due to encapsulation of magnet 110, is advantageous because it provides relatively more dipstick-element surface area upon which ferromagnetic materials 210 can be attracted to and collect than would otherwise be available if magnet 110 were not encapsulated.

Dipstick element 150 has dipstick-element length 170 that, upon attaching cap assembly 120 to a dipstick-entry orifice 142 of a combustion-engine sump 140 (via cap-assembly threading element 122 screwing into or mating with complimentary threading element 144 on a dipstick-entry orifice 142 of a combustion-engine sump 140), is configured to at least partially submerge magnet second half 114 (that is substantially encapsulated within dipstick element 150) beneath a liquid-fill level 146 within the combustion-engine sump 140. Persons of ordinary skill in the art will be able to determine a useful dipstick-element length 170 without having to exercise undue experimentation.

Figure 7:
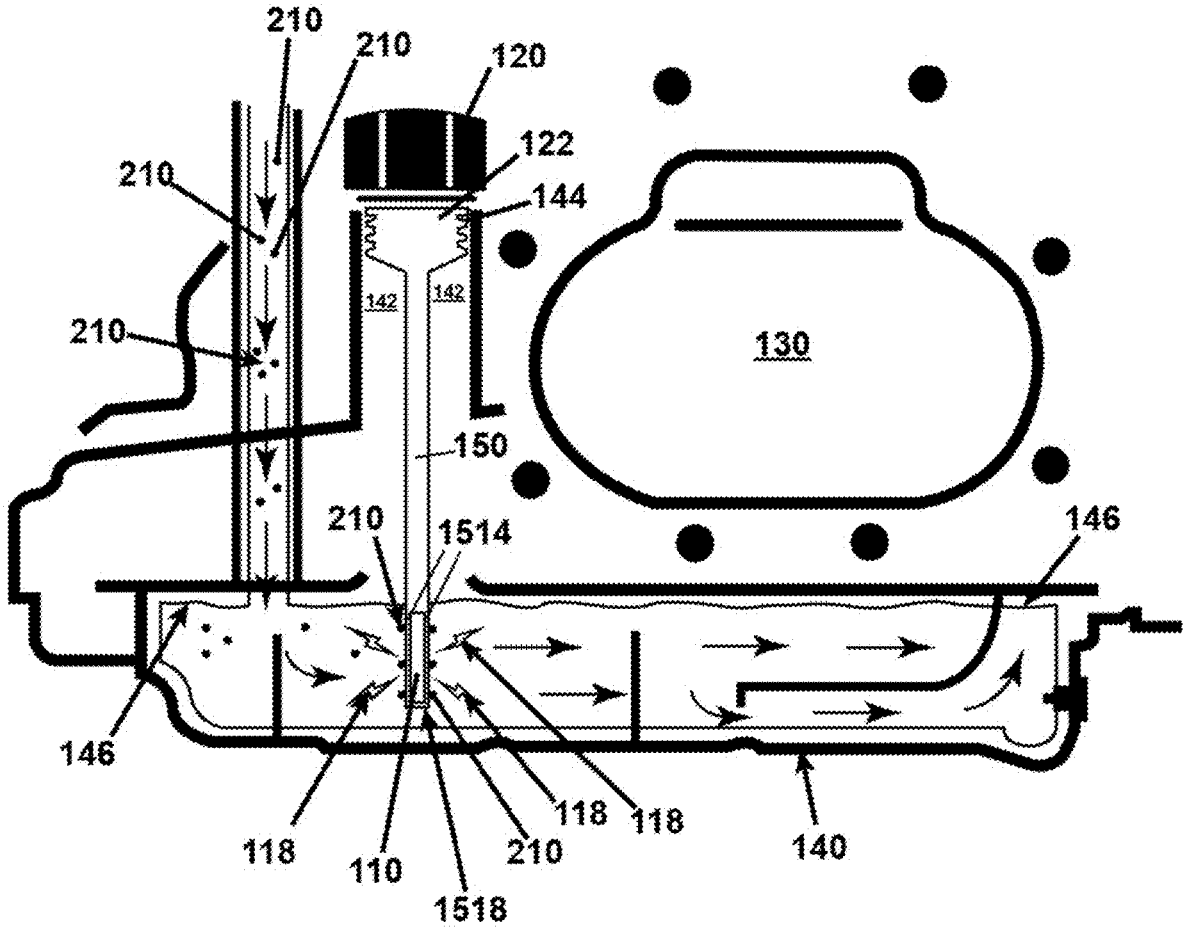
FIG. 7 shows a schematic of an embodiment in use.
Figure 8:
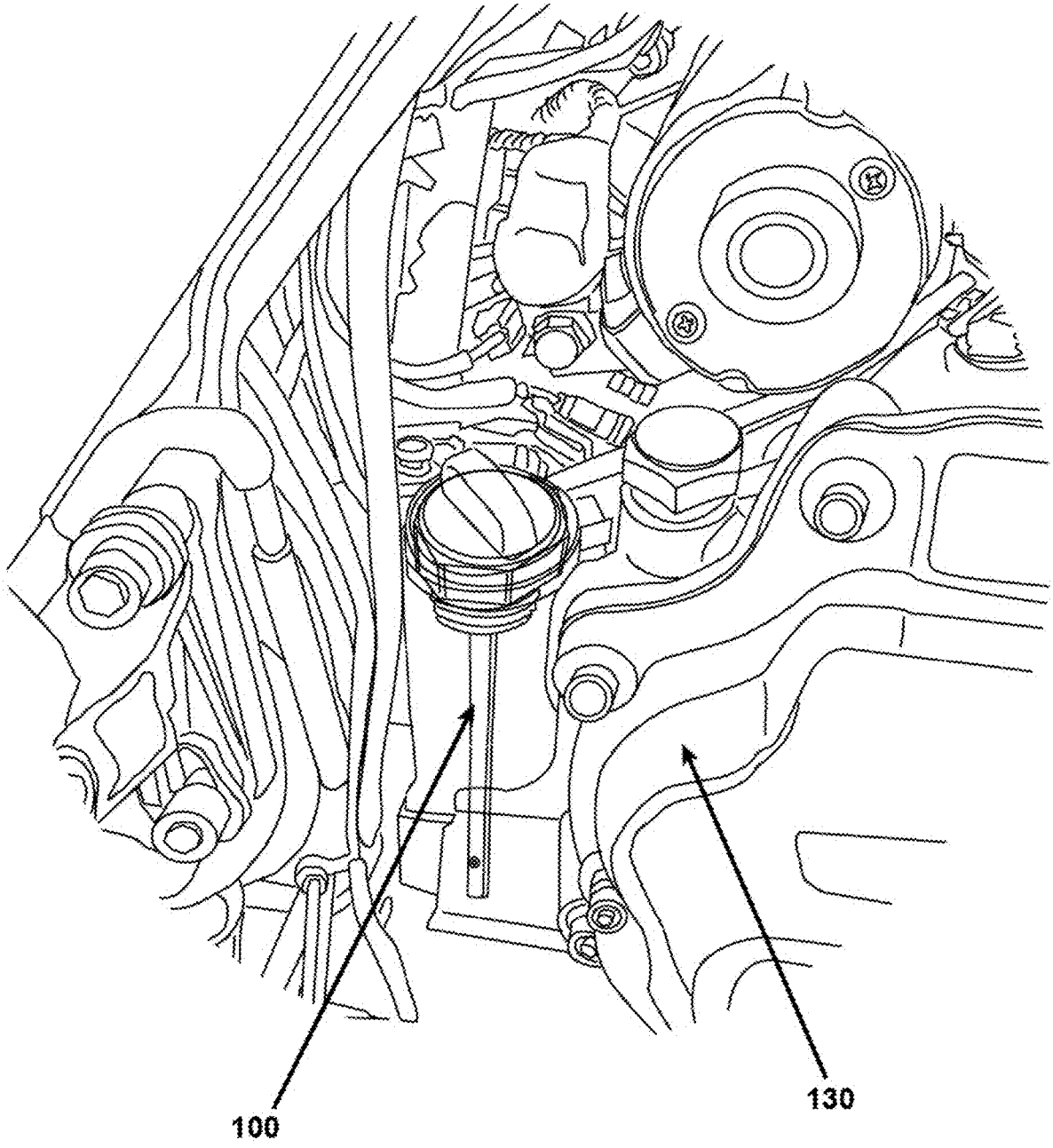
FIG. 8 shows an exemplary use of an embodiment.

FIGS. 7 and 8 show engine-oil dipstick 100 in use within combustion-engine sump environment 130; FIG. 7 provides a schematic of combustion-engine sump environment 130 and FIG. 8 shows engine-oil dipstick 100 in use in a more specific combustion-engine sump environment 130 that is part of a motorcycle. FIG. 7 shows magnet 110 generating magnetic field 118 that is attracting and collecting ferromagnetic materials 210 from engine-oil fluid flow represented by a plurality of arrows (shown circulating in a generally counter-clockwise direction). Ferromagnetic materials 210 are shown as being attracted to and collecting on dipstick-element wall 1514/dipstick-element wall exterior surface 1516 (shown in FIGS. 2, 4, 5, and 6). Dipstick-element wall 1514 has dipstick-element wall thickness 1518 that enables magnetic field 118 to pass through dipstick-element wall 1514 and thereby attract and collect ferromagnetic materials 210 on dipstick-element wall exterior surface 1516. Very generally, useful dipstick-element wall thickness (es) 1518 can be determined by persons having ordinary skill in the art without having to exercise undue experimentation; in embodiments, dipstick-element wall thickness 1518 is kept at a minimum to allow magnetic field 118 to attract ferromagnetic materials 210 that are in position 190 that is proximate to and outside of dipstick-element wall 1514.

In embodiments, dipstick element 150 is manufactured at least in part with a polymeric composition that can be selected by persons of ordinary skill in the art without having to exercise undue experimentation.

What is claimed is:

1. An engine-oil dipstick having a magnet comprising:
- a cap assembly that is configured to removably attach to a dipstick entry orifice of a combustion-engine sump;
- a dipstick element having a first end and a second end;
- the first end of the dipstick element attached to the cap assembly;
- a magnet that generates a magnetic field,
- the magnet having a first half and a second half;
- the second half of the magnet being closer to the second end of the dipstick than the first half of the magnet;
- the second half of the magnet being substantially encapsulated within the dipstick element;
- the dipstick element having a dipstick-element first half that includes the first end and a dipstick-element second half that includes the second end; and
- an orifice in the dipstick-element second half configured to allow visibility of the magnet.

2. An engine-oil dipstick having a magnet comprising:
- a cap assembly that is configured to removably attach to a dipstick entry orifice of a combustion-engine sump;
- a dipstick element having a first end and a second end;
- the first end of the dipstick element attached to the cap assembly;
- a magnet that generates a magnetic field,
- the magnet having a first half and a second half;
- the second half of the magnet being closer to the second end of the dipstick than the first half of the magnet;
- the second half of the magnet being substantially encapsulated within the dipstick element;
- the second half of the magnet having a second-half-of-the-magnet surface area;
- the portion of the second end of the dipstick that substantially encapsulates the second half of the magnet having an exterior surface;
- the exterior surface having an exterior-surface surface area; and
- the exterior-surface surface area being greater than the second-half-of-the-magnet surface area.

* * * * *